United States Patent [19]

Kwasnik et al.

[11] 4,314,787

[45] Feb. 9, 1982

[54] CHARGING CAR FOR COKE OVENS

[75] Inventors: Hans-Jürgen Kwasnik, Herne; Hans-Günter Piduch, Bochum, both of Fed. Rep. of Germany

[73] Assignee: Dr. C. Otto & Comp. GmbH, Bochum, Fed. Rep. of Germany

[21] Appl. No.: 116,439

[22] Filed: Jan. 29, 1980

[30] Foreign Application Priority Data

Jun. 2, 1979 [DE] Fed. Rep. of Germany ..... 2922571

[51] Int. Cl.[3] ..... C10B 31/02

[52] U.S. Cl. ..... 414/163; 193/30; 202/262

[58] Field of Search ..... 414/162–164; 202/262, 263; 193/30; 141/3 87, 388

[56] References Cited

U.S. PATENT DOCUMENTS

| | | | |
|---|---|---|---|
| 997,742 | 7/1911 | Bolz | 193/30 X |
| 3,419,163 | 12/1968 | Kostochka | 414/164 |
| 3,511,391 | 5/1970 | Tucker | 414/163 |
| 4,066,175 | 1/1978 | Schulte | 202/262 X |

*Primary Examiner*—Robert G. Sheridan

*Attorney, Agent, or Firm*—Thomas H. Murray; Clifford A. Poff

[57] ABSTRACT

A coal-charging apparatus includes a charging car with charging bins to discharge coal through filling tubes into charging holes in the roof of an oven chamber. A feed-screw conveys coal from the bottom of a charging bin to a trough communicating with a fixed filling tube. A peripheral trough on the bottom of this tube is filled with sand or liquid and receives a peripheral seal lip on the inside of a movable sealing tube. Hooks on the outside and at the top of the movable sealing tube engage a ring that is suspended by bearings at both ends of a stirrup. The filling tube is raised and lowered by a linkage system that includes a lever supported by a platform and operated by a piston and cylinder assembly. A closure plate is operated by a linkage including a lever supported by a platform and engaged with a piston and cylinder assembly. The closure plate is a leading edge that engages below a wall just above the fixed charging tube.

5 Claims, 5 Drawing Figures

CHARGING CAR FOR COKE OVENS

BACKGROUND OF THE INVENTION

This invention relates to a charging car or wagon adapted to move along the roof of a coke oven battery and, more particularly, to such a charging car having charging bins from which coal is discharged through filling tubes that are lowered onto frames of charging holes in the roof of the oven chamber.

SUMMARY OF THE INVENTION

It is an object of the present invention to provide a charging car that is movable along the roof of a coke oven battery to discharge coal into the oven chambers through movable filling tubes that are lowered to engage the frames of charging holes in a manner where means are provided to produce very thorough sealing from the external atmosphere when the filling tubes engage with the frames of the charging holes.

It is another object of the present invention to provide a charging car for discharging coal into a coking chamber of a battery of coke ovens where, during the charging process, tight sealing is insured, notwithstanding variations to vertical and horizontal dimensions of the charging holes as may be caused by wear, inaccurate positioning of the charging car or by alterations to the masonry structure of the oven roof.

It is another object of the present invention to suspend for intended vertical movement and in a flexible manner, a vertically-movable charging tube from a fixed charging tube to form a gas-tight connection in a charging car apparatus where the arrangement of parts is such that means for actuating the movable charging tube and means for actuating the sliding plate to close the aperture between a feed-screw trough communicating with a charging bin and the fixed charging tube are arranged so as to eliminate risk from flames arising during operation.

Another object of the present invention is to simplify the operation of a vertically-movable charging tube and linkage for a sliding plate adapted to close an aperture between a feed-screw trough of a charging bin and a fixed charging tube by providing that the linkage extends substantially vertical and immediately adjacent the casing of coal-conveying chambers.

More particularly, according to the present invention, there is provided a coal-charging apparatus adapted to move along the top of a battery of coke ovens wherein the roof for each coking chamber includes spaced-apart charging holes with frames normally covered by lids that are removed to feed a charge of coal into the coking chamber, the coal-charging apparatus including a charging car with charging bins to discharge coal into an oven chamber, filling tubes carried by the charging car to receive coal from the charging bins, the filling tubes including fixed and movable tube parts for communicating with the charging hole after removal of the cover therefor, each movable tube part having hooks on the outside thereof and a downwardly-extending seal lip on the inside thereof, each fixed tube having a peripheral trough containing sealant material on the outside thereof, a support ring to engage the hooks of each movable tube part, and a vertically-movable stirrup coupled for pivotal movement about a horizontal axis to each support ring to vertically position the movable tube part of a filling tube.

Thus, according to the present invention the vertically-movable charging tubes each have hooks on the outside at the top edge and a downwardly-extending sealing lip is disposed on the inside of the tube. In the lowered position of the charging tube, the sealing lip engages in a peripheral trough filled with fine grain or liquid sealant and disposed on the outside wall of the fixed charging tube. Hooks engage over a carrying ring retained by an outer vertically-movable stirrup for pivotal movement about a horizontal axis. The movable stirrup is perferably semicircular and generally horizontal when engaged with the carrying ring.

Since the carrying ring for the vertically-movable filling tube is pivotal, the tube can pivot about a horizontal axis such that its discharge orifice is adjustable horizontally and adaptable to the position of a charging hole frame. The bottom end of the movable charging tube is conically narrow and can slide on a matching conical top surface of a charging hole frame to a position where a tightly sealed closure is formed.

The peripheral trough which is filled with fine-grain material, such as sand, or with a liquid, is disposed on the outside of a fixed charging tube to cooperate with the inwardly-extending peripheral sealing lip of the lowerable charging tube so that the lip extends into the peripheral trough to form a gas-tight closure. In the novel charging car of the present invention, a feed screw is disposed at the bottom of each charging bin to convey coal to a trough disposed for communication with the bin. The fixed charging tube communicates with the trough base and is closable by a sliding closure plate. A vertical rail disposed on the outside wall of the casing for the feed-screw trough serves to form a guide for linkage used to raise and lower the stirrup. The means employed for guiding the linkage is of a very compact construction.

A platform is provided above each feed-screw trough and has an upright used to pivotally support a lever. One end of the lever is coupled to the linkage for raising and lowering the stirrup and the other end of the lever is coupled to a piston and cylinder assembly which is disposed on the platform for support thereby. A counterweight is preferably associated with one of the support arms to balance the load of the movable charging tube and enables manual raising of the tube in the event of an emergency.

The aforesaid platform is preferably provided with an additional upright on which a further lever is pivoted and a linkage for opening and closing a closure plate disposed between the feed-screw trough and the fixed charging tube is connected to one end of the additional lever. The rod end of a further piston and cylinder assembly also supported by the platform is connected to the remaining arm of the further lever. The latter linkage extends directly along the wall of the feed-screw trough.

After closing of the aperture by way of which the feed-screw trough communicates with the fixed charging tube, the closure plate engages at its front edge below a horizontal wall that cooperates with an inclined wall at the end of the path of the closure plate to bound a chamber closed off from the exterior. From this chamber, coal engaged by the closure plate during movement to the closed position drops into the fixed charging tube.

These features and advantages of the present invention as well as others will be more fully understood when the following description of a preferred embodiment is read in light of the accompanying drawings, in which.

Figure 2:
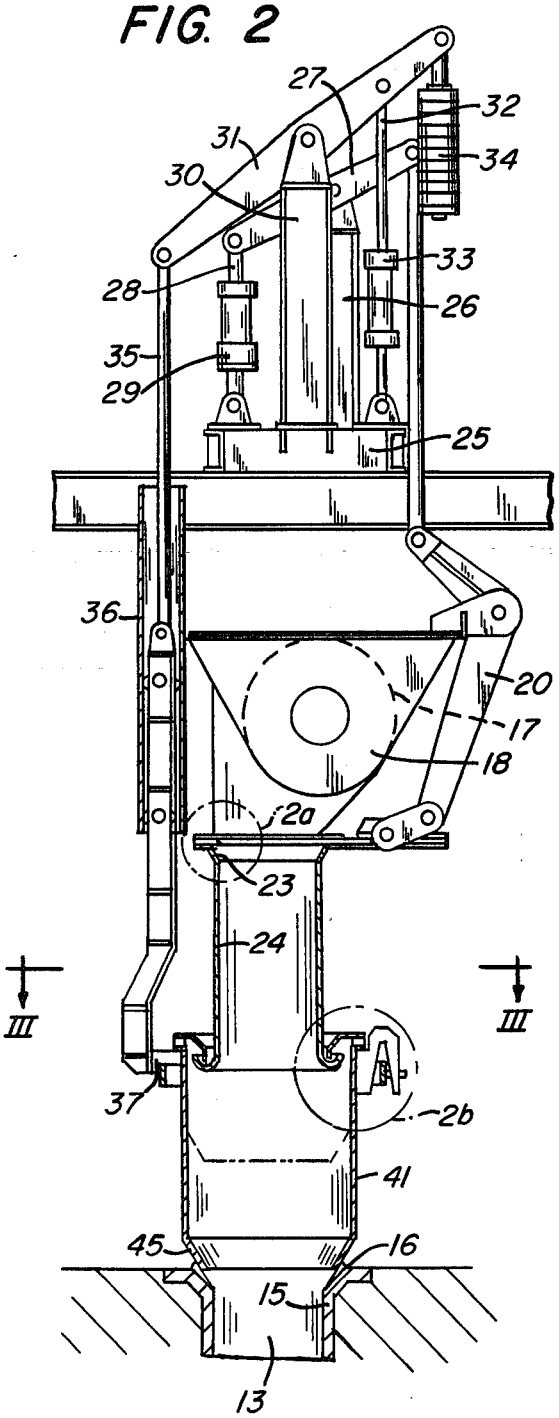
FIG. 2 is an enlarged view, partly in section, taken along line II—II of FIG. 1.
Figure 2A:
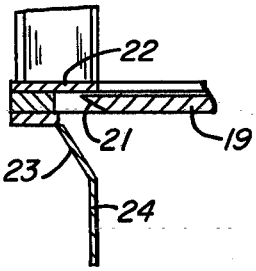
Figure 2B:
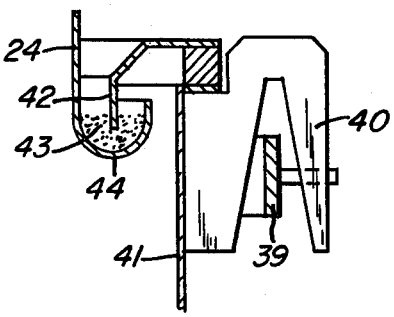

FIG. *2a* is an enlarged partial view of the region around the front edge of a sliding closure plate located within a phantom-line circle in FIG. 2 and identified by the reference numeral *2a;*

Figure 3:
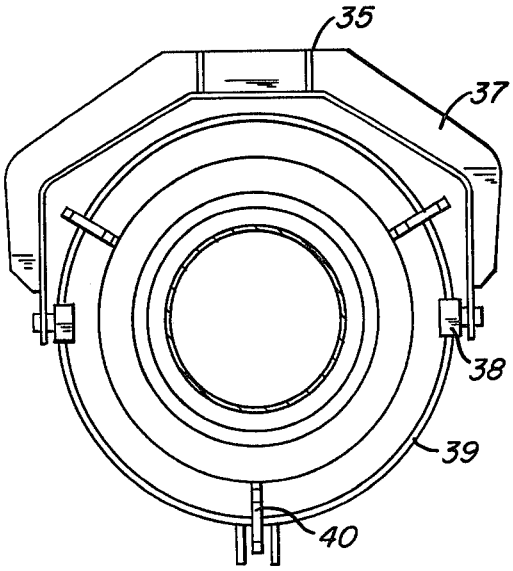

FIG. *2b* is an enlarged partial view of the top edge of a vertically-movable charging tube with hooks and a sealing lip in the region bounded by a phantom-line circle in FIG. 2 and identified by the reference numeral *2b;* and FIG. 3 is a plan view taken along line III—III of FIG. 2.

Figure 1:
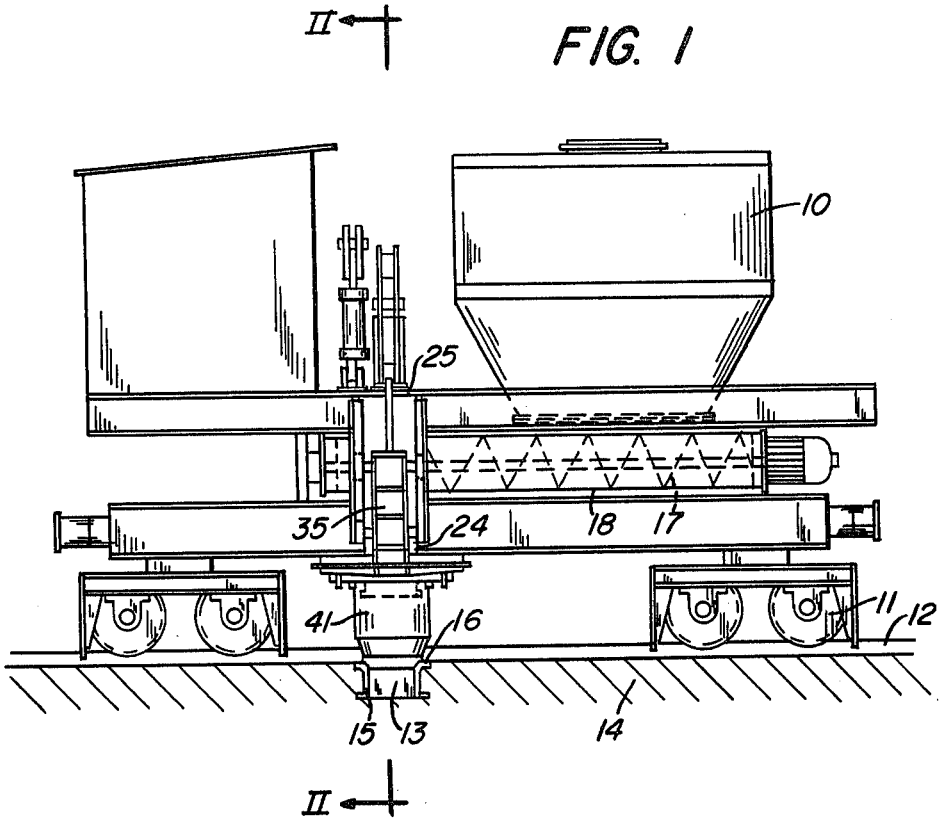
FIG. 1 is a side view taken along the direction of the axis of a coke oven chamber and illustrating a charging car adapted to move along an oven roof for a battery of coke ovens.

In FIG. 1, reference numeral 10 identifies one of a number of charging bins that is arranged on a charging car or wagon having wheels 11 engaged for movement along rails 12. The rails are supported by the roof 14 of a coke oven battery. Coke oven chambers extend in a horizontally spaced-apart relation between heating walls and have removable doors at their opposite ends for the discharge of coke from the oven chambers. Charging holes 13 in the oven roof are closed by removable covers fitted on frames 15. A plurality of such charging holes is provided at spaced-apart locations along each coking chamber. The frames 15 have conical engagement surfaces for the removable covers.

Below each bin 10, there extends a feed screw 17 coupled to a drive, not shown. The feed screw delivers coal to a feed-screw trough 18. An aperture in the bottom of the trough 18 is closed by a sliding closure plate 19 operated by a linkage 20. As shown in FIG. *2a*, closure plate 19 has a leading edge 21 that engages below wall 22 when the plate is moved to the closed position so that coal which is pushed in front of the plate 19 during movement to the closed position is guided by way of an inclined wall 23 into a fixed charging tube 24 therebelow. Above trough 18, there is a platform 25 supporting an upright 26. A lever 27 is supported by a pivot on the top portion of the upright. The arm of the lever 27 which is on the left as one views FIG. 2, is engaged by the rod end 28 of a piston and cylinder assembly 29 which is supported by the platform. The arm of the lever 27 which is on the right as one views FIG. 2, is engaged by linkage 20 coupled to the closure plate 19.

Platform 25 supports an upright 30 having a top portion to which a lever 31 is mounted. The rod end 32 of a piston and cylinder assembly 33 is coupled to the arm of lever 31 which is at the right side of the upright 30 as one views FIG. 2. A counterweight 34 is suspended at the right-hand side (FIG. 2) of lever 31. The arm of the lever 31 which is on the left as one views FIG. 2 is engaged by a linkage 35. A vertical guide formed by a rail 36 is used to guide the linkage along the casing of the feed-screw trough 18.

As shown in FIG. 3, a stirrup 37 is disposed at the bottom end of linkage 35. A carrying ring 39 is suspended by bearings 38 at both ends of the stirrup 37. Three hooks 40 disposed at the top end of the movable charging tube 41 on the outside thereof engage over the ring 39 when the tube 41 is lowered. Tube 41 has on its inside, a peripheral sealing lip 42 which, as the tube 41 descends, engages in a peripheral trough 44. Trough 44 is filled with sand 43 and forms the bottom end of the fixed charging tube 24. The bottom closure of the charging tube 41 is formed by a conically-converging wall 45. In FIG. 2, the raised or upper position of the movable charging tube 41 is shown by phantom lines.

When it is desired to feed a coal charge into a coking chamber, the charging car is moved into a charging position above the coking chamber along the oven roof. The charging hole covers are first raised to expose the conical engagement seat of the charging holes 13 and then linkage 35 is actuated to lower the movable charging tube part 41 into the position shown in FIG. 1. In this position, the bottom inclined surface 45 of the charging tube 41 engages with the conical surface 16 of frame 15 to form a tightly sealed enclosure therewith. Closure plate 19 is then opened and the feed screw 17 is caused to rotate by energizing the drive coupled thereto. Rotation of the feed screw continues until a sufficient quantity of coal is delivered from the bin into the filling tube and thence into the charging hole 13. Thereafter, plate 19 is moved into a closed position. When there is to be no further charging of coal into the oven chamber, the stirrup 37 is raised by operation of the linkage 35. The ring 39 engages below the hooks 40 and lifts the lowerable charging tube part 41 into the position located above the oven roof which is suitable for movement of the charging car therealong.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A coal-charging apparatus adapted to move along the top of a battery of coke ovens wherein the roof for each coking chamber includes spaced-apart charging holes with frames normally covered by lids that are removed to feed a charge of coal into the coking chamber, the coal-charging apparatus including a charging car with charging bins to discharge coal into an oven chamber, a feed screw to convey coal from the bottom of each charging bin, a trough communicating with the charging bin for conveyance of coal by said feed screw, filling tubes carried by said charging car to receive coal from said trough, said filling tubes including fixed and movable tubes for communication with the charging hole after removal of the lid therefor, each movable tube having hooks on the outside thereof and a downwardly-extending seal lip on the inside thereof, each fixed tube having a peripheral trough containing sealant material on the outside thereof, a support ring to engage the hooks of each movable tube, a vertically-movable stirrup coupled for pivotal movement about a horizontal axis to each support ring to vertically position the movable tube of a filling tube, a vertical guide on the outside wall of said trough, and a linkage guided by said vertical guide for raising and lowering a stirrup.

2. The coal-charging apparatus according to claim 1 wherein said vertically-movable stirrup includes a substantially semicircular member extending horizontally about a support ring.

3. The coal-charging apparatus according to claim 1 further including a platform for each trough, an upstanding support carried by each platform, a lever pivoted for support by the upright, a linkage connected to one end of said lever, and piston and cylinder assembly means supported by said platform for operative connection to the other end of said lever.

4. The coal-charging apparatus according to claim 3 wherein each platform further includes a further upstanding support, a further lever pivotally supported by said further upstanding support, a linkage extending along the outside wall of said trough while coupled to one end of the further lever for opening and closing said closure plate between the trough and the fixed charging tube, and piston and cylinder assembly means supported by said platform for operative connection to the other end of the further lever for moving said closure plate.

5. The coal-charging apparatus according to claim 1 wherein said closure plate engages along a leading edge below a horizontal wall cooperating with an inclined wall to bound a chamber closed off from the exterior and from which chamber coal engaged by the closure plate while advanced toward the closed position drops into the fixed charging tube.

* * * * *